US009291344B2

(12) United States Patent
Brodeβer et al.

(10) Patent No.: US 9,291,344 B2
(45) Date of Patent: Mar. 22, 2016

(54) FORCED-FLOW STEAM GENERATOR

(75) Inventors: Joachim Brodeβer, Nürnberg (DE); Jan Brückner, Uttenreuth (DE); Martin Effert, Erlangen (DE); Joachim Franke, Nürnberg (DE); Tobias Schulze, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 402 days.

(21) Appl. No.: 13/813,522

(22) PCT Filed: Jun. 15, 2011

(86) PCT No.: PCT/EP2011/059930

§ 371 (c)(1),
(2), (4) Date: Apr. 11, 2013

(87) PCT Pub. No.: WO2012/016749

PCT Pub. Date: Feb. 9, 2012

(65) Prior Publication Data

US 2013/0205784 A1 Aug. 15, 2013

(30) Foreign Application Priority Data

Aug. 4, 2010 (DE) ..... 10 2010 038 883

(51) Int. Cl.

| | |
|---|---|
| ***F01K 23/06*** | (2006.01) |
| ***F22B 29/06*** | (2006.01) |
| ***F22B 21/34*** | (2006.01) |
| ***F22B 21/36*** | (2006.01) |

(Continued)

(52) U.S. Cl.

CPC ..... *F22B 29/062* (2013.01); *F01K 7/16* (2013.01); *F22B 21/34* (2013.01); *F22B 21/366* (2013.01); *F22B 29/02* (2013.01); *F22B 37/74* (2013.01)

(58) Field of Classification Search

CPC ..... F01K 7/16; F22B 21/34; F22B 21/366; F22B 29/02; F22B 29/062; F22B 37/74

USPC ..... 123/1, 6, 235.23

See application file for complete search history.

(56) References Cited

U.S. PATENT DOCUMENTS

| | | | |
|---|---|---|---|
| 4,577,593 | A | 3/1986 | Teigen |
| 5,701,850 | A | 12/1997 | Kohler |

(Continued)

FOREIGN PATENT DOCUMENTS

| | | | |
|---|---|---|---|
| CN | 1239540 | A | 12/1999 |
| CN | 1336997 | A | 2/2002 |

(Continued)

*Primary Examiner* — Jesse Bogue

(57) ABSTRACT

A forced-flow steam generator includes first and second steam generator pipes which form a surrounding wall, wherein the first and second steam generator pipes are welded in a gas-tight fashion and are traversable by flow in a vertical direction. A passage collector is arranged within the surrounding wall, wherein the passage collector connects the first steam generator pipes with the second steam generator pipes. The first steam generator pipes are connected at an outlet side to an inlet side of the second steam generator pipes, wherein the second steam generator pipes are connected in series with the first steam generator pipes. Each of the second generator pipes has a restrictor device. Further, a power plant with a forced-flow steam generator is provided.

8 Claims, 2 Drawing Sheets

(51) Int. Cl.

| | |
|---|---|
| ***F22B 29/02*** | (2006.01) |
| ***F01K 7/16*** | (2006.01) |
| ***F22B 37/74*** | (2006.01) |

(56) References Cited

U.S. PATENT DOCUMENTS

| | | | | | |
|---|---|---|---|---|---|
| 5,979,369 | A | * | 11/1999 | Wittchow et al. | 122/235.12 |
| 5,983,639 | A | * | 11/1999 | Kral et al. | 60/646 |
| 2008/0141646 | A1 | * | 6/2008 | Yoshida | F01K 23/068 60/39.12 |
| 2008/0257282 | A1 | | 10/2008 | Effert | |
| 2012/0024241 | A1 | * | 2/2012 | Bruckner et al. | 122/7 R |

FOREIGN PATENT DOCUMENTS

| | | | |
|---|---|---|---|
| CN | 1526059 | A | 9/2004 |
| CN | 101002054 | A | 7/2007 |
| DE | 2144675 | C3 | 5/1981 |
| DE | 3544504 | A1 | 8/1986 |
| GB | 913033 | A | 12/1962 |
| WO | WO 2010064466 | A1 | 6/2010 |

* cited by examiner

FORCED-FLOW STEAM GENERATOR

CROSS REFERENCE TO RELATED APPLICATIONS

This application is the US National Stage of International Application No. PCT/EP2011/059930 filed Jun. 15, 2011, and claims the benefit thereof. The International Application claims the benefits of German Patent Application No. 10 2010 038 883.1 DE filed Aug. 4, 2010. All of the applications are incorporated by reference herein in their entirety.

FIELD OF INVENTION

The invention relates to a forced-flow steam generator having a surrounding wall formed from steam generator pipes which are welded in a gas-tight fashion and traversable by flow in the vertical direction, in which within the surrounding wall there is arranged a passage collector by means of which the outlet side of a first multiplicity of steam generator pipes in parallel configuration is connected at the flow medium side to the inlet side of a second multiplicity, in series configuration with and downstream of the first multiplicity, of steam generator pipes in parallel configuration. In addition, it relates to a power plant with such a steam generator.

BACKGROUND OF INVENTION

A steam generator is a plant for the generation of steam from a flow medium. In such a plant a flow medium, typically water, is heated and converted into steam. The steam is then used to drive machines or to generate electricity. Usually a steam generator comprises an evaporator to generate the steam and a superheater, in which the steam is heated to the temperature required for the user. Frequently a preheater is arranged upstream of the evaporator to make use of waste heat, and further increases the efficiency of the entire plant.

In industrial use today steam generators are usually designed as water-tube boilers, i.e. the flow medium is fed into steam generator pipes. The steam generator pipes can be welded together in a gas-tight fashion and thus form a surrounding wall, within which the hot gas supplying the heat is fed. Steam generators can be of either a vertical or horizontal construction, i.e. the hot gas is fed in a vertical or horizontal direction.

Steam generators can furthermore be designed as forced-flow steam generators, wherein the passage of the flow medium is forced by a feed pump. The flow medium is fed into the boiler by the feed pump and flows through the preheater, the evaporator and the superheater in succession. The heating of the feed water to saturated steam temperature, the evaporation and superheating take place continuously in a single flow, so that—at least when operating at full load—no distinct separation system for water and steam is necessary. Steam generators can also be operated at supercritical pressures. The definitions of the individual heating surfaces of preheater, evaporator and superheater are strictly speaking no longer appropriate in this operating mode, as a continuous phase transition takes place.

In a variant of the vertically piped through-flow steam generator the pipework of the surrounding wall is divided into a lower and an upper section, wherein the lower section comprises a first multiplicity of steam generator pipes in parallel configuration and the upper section a second multiplicity of steam generator pipes in parallel configuration, in series configuration with and downstream of the first multiplicity. The lower and the upper section are connected to each other by a passage collector. By this means on the one hand equalization of pressure between the steam generator pipes in parallel configuration is obtained, and on the other hand at least partial mixing of the flow medium from different steam generator pipes as well.

In the case of such through-flow steam generators with steam generator pipes and passage collectors traversable by flow in the vertical direction it has now been ascertained that individual pipes in the upper section of the surrounding wall can assume inadmissibly high temperatures, which under certain circumstances can result in a deterioration of the pipe wall, with the occurrence of these excessive temperatures being associated with certain operating parameters.

SUMMARY OF INVENTION

It is an object to specify a forced-flow steam generator of the aforementioned type which has a particularly long service life and a particularly low susceptibility to faults regardless of the operating state.

This object is achieved by a steam generator as claimed in the claims, wherein the steam generator pipes arranged downstream of the passage collector each have a restrictor device.

The invention proceeds from the consideration that the superheating of individual steam generator pipes is attributable to insufficient dissipation of the heat occurring through the flow medium. Insufficient heat dissipation occurs if the mass flow of the steam generator pipe concerned is too low. In the case of a distinct natural circulation characteristic, in the case of a very low inlet steam content and very low heat supply the hydrostatic pressure drop in these pipes is already almost as great or equally as great as the entire pressure differential between inlet and outlet of the steam generator pipe. The residual pressure differential as a driving force of the flow is accordingly very low or disappears completely so that in the worst case the flow stagnates.

Although the passage collector should bring about a certain equalization between the pipes downstream of it in order to mitigate this effect, it has however been recognized that although the passage collector brings about complete pressure equalization, it does not bring about complete mixing of the incoming flow medium, which would result in equalization of the water and steam content in the steam generator pipes downstream of it. On account of the low steam content from the less well heated steam generator pipes of the lower section and additional local separation phenomena in the collector, in certain operating states the steam content may therefore nevertheless approach zero at the inlet to individual pipes of the upper vertical bore. This phenomenon should therefore be avoided by means of a sufficient reduction of the natural circulation characteristic. This can be achieved by increasing the friction pressure drop in the respective steam generator pipe. For this purpose, the steam generator pipes arranged downstream of the passage collector should have in each case one restrictor device.

In an advantageous embodiment the respective restrictor device is arranged at the upper outlet of the surrounding wall. Such an arrangement makes a particularly simple construction of the steam generator possible and at the same time permits the retrofitting of existing systems having the aforementioned problem.

Advantageously, the restrictor device is designed as a simple aperture. This permits a particularly simple local reduction of the nominal size of the steam generator pipe concerned and as a result, a simple increase in the friction pressure drop. This measure also permits particularly simple installation of the restrictor device in order to reduce the natural circulation characteristic.

The surrounding wall of a steam generator in an upright design can have different horizontal cross-sections. A particularly simple construction is possible if the cross-section is essentially rectangular. In the case of such steam generators, in particular the steam generator pipes arranged in the corner areas are heated particularly weakly as they are furthest from the center of the hot gas channel and at the same time have a particularly small heat transfer surface. As a result, the steam content of individual corner pipes of the lower section of the vertical pipework may approach zero, resulting in an unevenly distributed water-steam mixture entering the interim collector here. As the interim collector does not bring about sufficient mixing here either, the mass flow may come to a standstill in the corner pipes arranged downstream and the heat dissipation may be insufficient as a result. In the case of precisely such a steam generator, advantageously the steam generator pipes arranged downstream of the passage collector therefore have in each case one restrictor device.

The passage collector may be arranged in a continuous, horizontal circumferential fashion, i.e. it connects all the steam generator pipes of the surrounding wall arranged below or above to each other. In spite of the complete pressure equalization via all the pipes, separation of water and steam content may nevertheless occur. Advantageously such a forced-flow steam generator therefore also has in each case one restrictor device in the steam generator pipes arranged downstream of the passage collector.

The pipework below the passage collector may be spiral-shaped and circumferential in design, with the pipes being routed circumferentially around the entire surrounding wall. Although this requires a more complex construction as well as a smaller number of steam generator pipes in the lower area, heating differences in various areas of the surrounding wall are largely equalized as a result. Nevertheless it has been recognized that in such a construction random local separation, which causes the aforementioned problems of an inadequate mass flow in the pipes arranged downstream of the passage collector, may also occur in the passage collector. Therefore in such a construction as well, the steam generator pipes arranged downstream of the passage collector advantageously have in each case one restrictor device.

In the case of fossil-fuel fired steam generators, heat input into the steam generator pipes of the combustion chamber takes place not only by means of convection but a large proportion of the heat is introduced into the steam generator pipes by means of thermal radiation. In particular, in such steam generators the differences in the heating of individual steam generator pipes may therefore be particularly great. Therefore a steam generator with a combustion chamber with a number of burners for fossil fuel advantageously has one restrictor device in the steam generator pipes arranged downstream of the passage collector.

In an advantageous embodiment a steam turbine, for example for electricity generation, is arranged at the flow medium side downstream of the forced-flow steam generator. In addition, a power plant advantageously has such a steam generator.

The advantages obtained with the invention comprise in particular ensuring sufficient heat dissipation in each pipe, and as a result inadmissibly high temperatures which might lead to damage to the pipe wall being avoided, through the arrangement of one restrictor device in the steam generator pipes of a forced-flow steam generator arranged downstream of the passage collector. This measure is based on the knowledge that a significant natural circulation characteristic which is reduced by the arrangement of restrictors is also present in a forced-flow steam generator. Lastly, restrictions in the operation of a power plant are avoided as a result.

BRIEF DESCRIPTION OF THE DRAWINGS

The invention is explained in more detail on the basis of a drawing. The figures show.

The same parts have the same reference characters in all the figures.

DETAILED DESCRIPTION OF INVENTION

Figure 1:
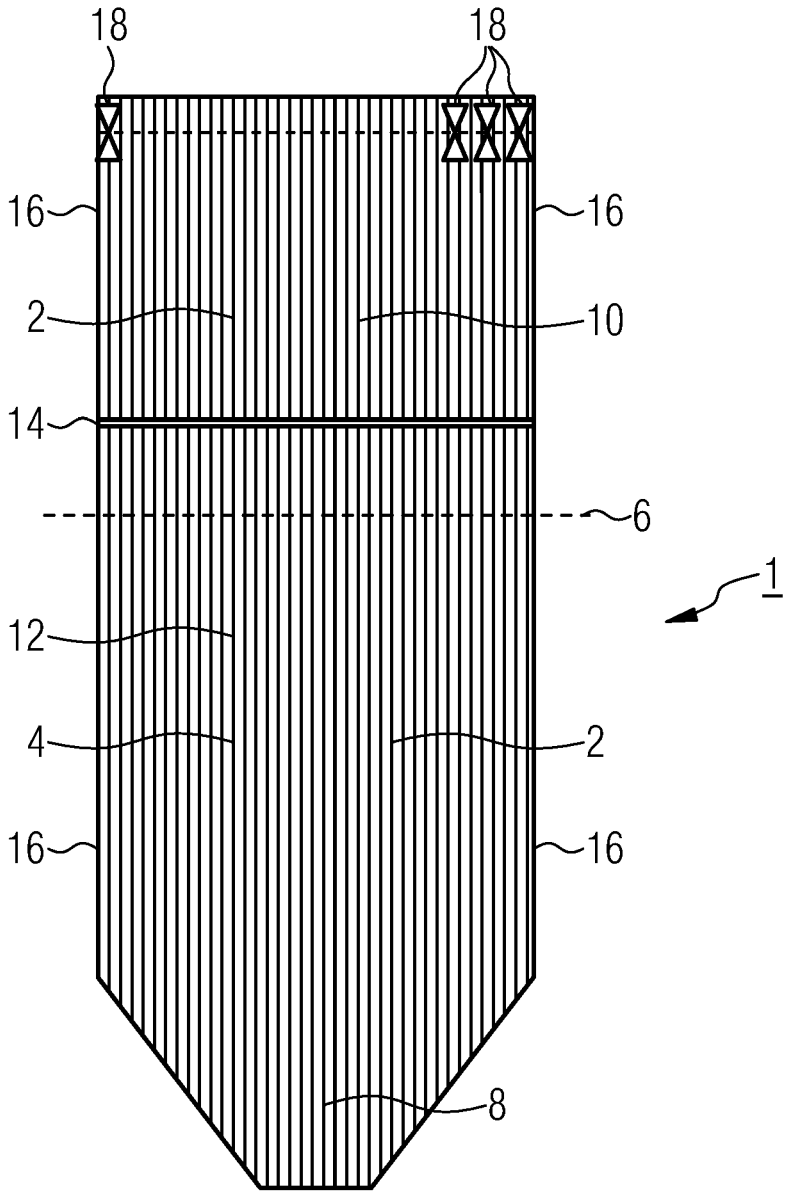
FIG. 1 a diagram of a vertically piped forced-flow steam generator with passage collector, and FIG. 2 a graphic presentation of the mass flow density and the fluid temperature at the outlet of a comparatively weakly heated corner pipe of the forced-flow steam generator with and without a restrictor device.

FIG. 1 is a diagram of a fossil-fuel fired, vertically piped forced-flow steam generator 1 in accordance with the invention. The forced-flow steam generator 1 comprises a surrounding wall 4 formed from steam generator pipes 2 which are welded in a gas-tight fashion. The surrounding wall 4 has an essentially rectangular horizontal cross-section 6. A combustion chamber 8 with a number of burners (not shown in more detail) for the combustion of a fossil fuel and which supply the heat to the steam generator pipes 4 is arranged in the lower section of the forced-flow steam generator 1.

The surrounding wall 4 is divided into an upper section 10 and a lower section 12, wherein the sections 10 and 12 are connected to each other via a passage collector 14. The pipework in the lower section 12 is arranged vertically here, but can also be arranged in a spiral shape circumferentially around the surrounding wall. The passage collector 14 collects all the flow medium emerging from the steam generator pipes 2 of the lower section 12 and thus enables pressure equalization between the steam generator pipes 2 connected in parallel configuration. Subsequently the flow medium is fed from the passage collector 14 into the steam generator pipes 2 of the upper section 10 where it is further heated and if need be superheated. After further superheating in heating surfaces (not shown), the superheated steam is supplied to a steam turbine (not shown in more detail) in a power plant.

The heat generated by the burners is absorbed as far as possible via thermal radiation by the steam generator pipes 2. In particular in the corner pipes 16 of the lower section 12, on account of their position at the greatest distance from the center of the forced-flow steam generator 1 and on account of the geometric arrangement of the surface receiving a particularly small amount of heat, the heat input is so low that the flow medium from the corner pipes 16 of the lower section 12 entering into the passage collector 14 has a comparatively low steam content.

Although the passage collector 14 now brings about complete pressure equalization, complete mixing of the incoming flow medium does not take place, however. On account of the aforementioned low steam content at the outlet from the corner pipes 16 of the lower section 12 as well as additional local separation phenomena in the passage collector 14, the steam content at the inlet into individual steam generator pipes 2 of the upper section 10 may be very low. Depending on the operating state of the forced-flow steam generator 1, in the case of a disadvantageous layout of the pipework of the upper section 10 this may result in a significant interruption of the rate of flow of individual steam generator pipes 2 through to stagnation. This in turn can result in insufficient heat dissipation and inadmissibly high fluid temperatures, with the pipe wall assuming inadmissibly high temperatures and being destroyed in the end.

Figure 2:
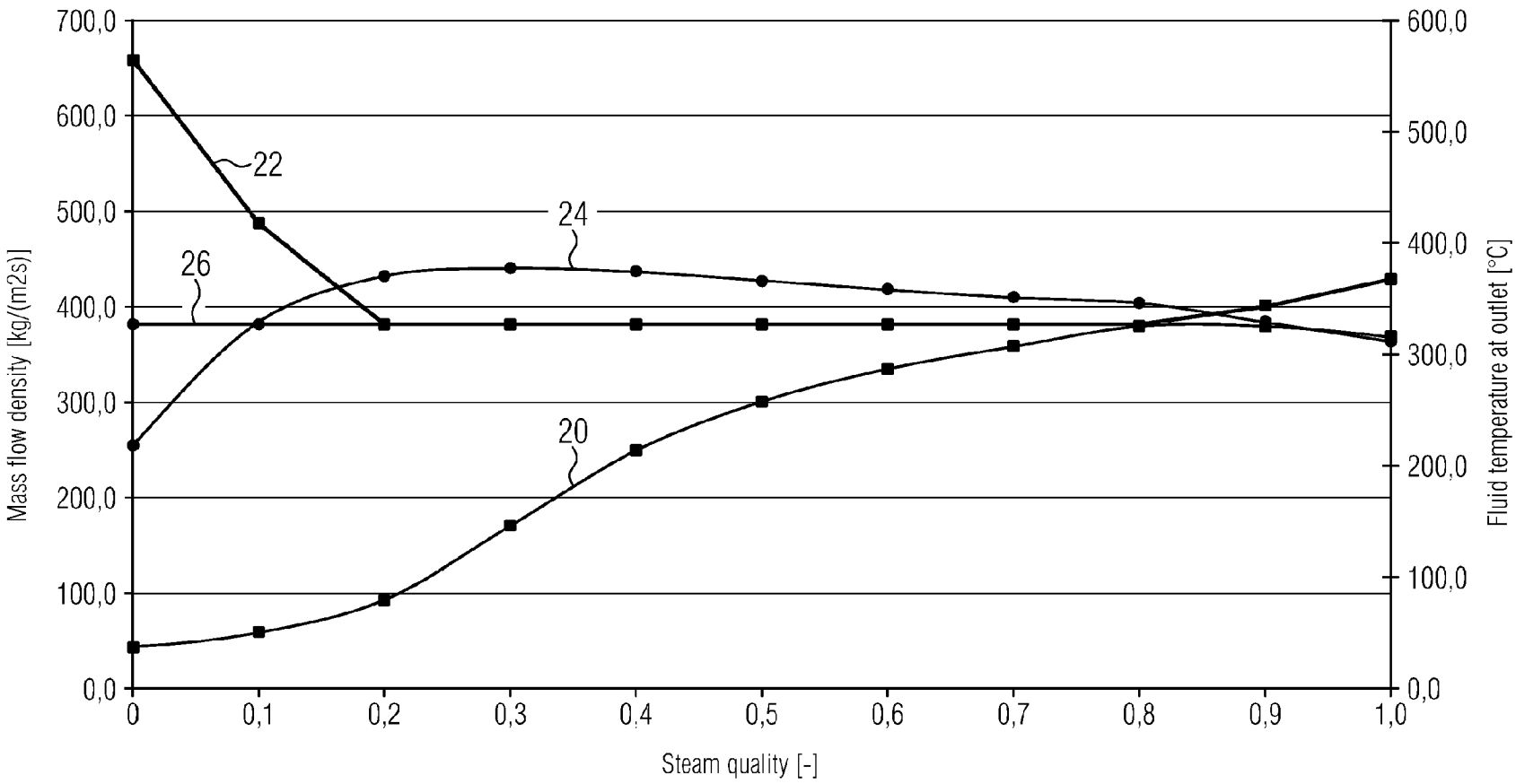

To avoid such damage, in the exemplary embodiment restrictor devices 18 are arranged at the outlet of all steam generator pipes of the upper area 10, wherein for ease of presentation only individual restrictor devices 18 are shown by way of example. The restrictor devices 18 are each designed as a aperture, as a result of which the overall pressure drop is increased for all the pipes in parallel configuration. This results in the hydrostatic pressure drop in the respective steam generator pipes 2, in particular in the corner pipes 16, being reduced in relative terms. As a result a sufficient pressure differential always remains as a driving force of the flow. This effect is clarified in FIG. 2:

FIG. 2 shows a graphic presentation of the parameters of the flow medium in a corner pipe 16 of the upper area 10 with and without a restrictor device 18 with a comparatively low heat supply and for partial-load operation of the steam generator 1. The left-hand scale shows the mass flow density in the corner pipe 16 in kilograms per square meter and second (kg/m2 s), the right-hand scale shows the fluid temperature at the outlet of the corner pipe 16 in degrees Celsius (° C.), each plotted against the steam content of the flow medium at the pipe inlet.

Curved line 20 shows the mass flow density in the corner pipe 16 without a separate restrictor device 18. The decline of the curved line 20 to the left side of the graphic presentation clearly shows how the mass flow density in the corner pipe 16 decreases toward lower steam content. With a steam content of 0, the mass flow density falls to a value of 40 kg/m2 s, which is practically equivalent to stagnation of the flow in the pipe. Sufficient heat dissipation in the pipe is no longer ensured and accordingly the temperature of the flow medium and consequently of the corner pipe 16 increases significantly from a steam content of approximately 0.2, as curved line 22 shows.

When a restrictor device 18 is arranged at the outlet of the corner pipe 16, however, the friction pressure drop increases and as aforementioned thus reduces the natural circulation characteristic and therefore reduces an excessive relative hydrostatic pressure drop in the corner pipe 16. Although curved line 24 also shows that the mass flow density in the corner pipe 16 declines toward lower steam content, with a steam content of 0 the value of the mass flow density also remains at a substantially higher value (here 260 kg/m2 s) than in an arrangement without a restrictor device 18. As curved line 26 makes clear, this results in sufficient heat dissipation being ensured in the corner pipe 16 at any steam content, i.e. the temperature only increases to a slight extent or remains constant. As a result, damage to the surrounding wall 4 in the upper area 10 by excessive temperatures is avoided and an overall longer service life of the forced-flow steam generator 1 is obtained.

The invention claimed is:

1. A forced-flow steam generator, comprising:

first and second steam generator pipes which form a surrounding wall, wherein the first and second steam generator pipes are welded in a gas-tight fashion and are traversable by flow in a vertical direction, a passage collector arranged within the surrounding wall, wherein the passage collector connects the first steam generator pipes with the second steam generator pipes, wherein the first steam generator pipes are connected at an outlet side to an inlet side of the second steam generator pipes, wherein the second steam generator pipes are connected in series with the first steam generator pipes, and wherein the second generator pipes each have a restrictor device, wherein each restrictor device is arranged at an upper outlet of the surrounding wall, and wherein each restrictor device is designed as an aperture including a smaller diameter than the second generator pipe.

2. The forced-flow steam generator as claimed in claim 1, wherein the first steam generator pipes are connected to each other in parallel, wherein the second steam generator pipes are connected to each other in parallel, and wherein the first steam generator pipes are connected in series with the second steam generator pipes.

3. The forced-flow steam generator as claimed in claim 1, wherein the surrounding wall has an essentially rectangular horizontal cross-section.

4. The forced-flow steam generator as claimed in claim 1, wherein the passage collector is arranged horizontally and circumferentially around the surrounding wall, wherein the first steam generator pipes are arranged below the passage collector in the surrounding wall, and wherein the second steam generator pipes are arranged above the passage collector in the surrounding wall.

5. The forced-flow steam generator as claimed in claim 4, wherein the steam generator pipes upstream of the passage collector are arranged in a spiral shape circumferentially in the surrounding wall.

6. The forced-flow steam generator as claimed in claim 1, further comprising:

a combustion chamber with a plurality of burners for fossil fuel.

7. The forced-flow steam generator as claimed in claim 1, further comprising:

a steam turbine arranged downstream at a flow medium side.

8. A power plant, comprising:

a forced-flow steam generator as claimed in claim 1.

* * * * *